US011976845B2

(12) United States Patent
Kim et al.

(10) Patent No.: US 11,976,845 B2
(45) Date of Patent: May 7, 2024

(54) HUMIDIFIER

(71) Applicant: Coway Co., Ltd., Gongju-si (KR)

(72) Inventors: Do-Yeop Kim, Seoul (KR); Hyun-Jin Hong, Seoul (KR); Sang-Woo Kang, Seoul (KR); An-Ho Cho, Seoul (KR)

(73) Assignee: Coway Co., Ltd., Gongju-si (KR)

( * ) Notice: Subject to any disclaimer, the term of this patent is extended or adjusted under 35 U.S.C. 154(b) by 209 days.

(21) Appl. No.: 17/420,532

(22) PCT Filed: Dec. 26, 2019

(86) PCT No.: PCT/KR2019/018481
§ 371 (c)(1),
(2) Date: Jul. 2, 2021

(87) PCT Pub. No.: WO2020/141796
PCT Pub. Date: Jul. 9, 2020

(65) Prior Publication Data

US 2022/0082274 A1 Mar. 17, 2022

(30) Foreign Application Priority Data

Jan. 3, 2019 (KR) ..... 10-2019-0000920

(51) Int. Cl.
*F24F 6/04* (2006.01)
*F24F 11/00* (2018.01)
*F24F 6/00* (2006.01)

(52) U.S. Cl.
CPC ..... *F24F 6/04* (2013.01); *F24F 11/0008* (2013.01); *F24F 2006/008* (2013.01)

(58) Field of Classification Search
CPC .... F24F 6/04; F24F 11/0008; F24F 2006/008; F24F 6/043; F24F 2013/205;
(Continued)

(56) References Cited

U.S. PATENT DOCUMENTS 3,361,415 A * 1/1968 Lane ..... G05D 22/02 210/138
5,368,784 A * 11/1994 Annestedt, Sr. ..... B01F 23/215 261/106

(Continued)

FOREIGN PATENT DOCUMENTS

CN 1399104 A 2/2003
CN 101936586 * 1/2011

(Continued)

OTHER PUBLICATIONS

Epo translation of KR 20120113026 (Year: 2012).*

(Continued)

*Primary Examiner* — Stephen Hobson
(74) *Attorney, Agent, or Firm* — Oblon, McClelland, Maier & Neustadt, L.L.P.

(57) ABSTRACT

A humidifier for which the cleaning of a water tank is easy includes: a water tank which is mounted inside a housing and stores water; a humidification member which is immersed in the water stored in the water tank and performs humidification; a water container provided with an opening/closing valve which is opened and closed to supply water stored therein to the water tank; a water container support member which is detachably mounted to an upper part of the water tank and on which the water container is seated; and a water supply control member which is mounted to the water container support member and opens and closes the opening/closing valve so that the water can be supplied from the water container to the water tank.

12 Claims, 9 Drawing Sheets

(58) Field of Classification Search
CPC ..... F24F 2221/22; F24F 13/20; F24F 11/89; F24F 11/88
See application file for complete search history.

(56) References Cited

U.S. PATENT DOCUMENTS

| | | | | | |
|---|---|---|---|---|---|
| 5,857,350 | A * | 1/1999 | Johnson | F28D 5/00 | 261/106 |
| 6,053,482 | A * | 4/2000 | Glenn | F24F 6/043 | 261/DIG. 46 |
| 6,427,984 | B1 * | 8/2002 | Mulvaney | F24F 6/043 | 261/107 |
| 6,945,519 | B2 * | 9/2005 | Parker | F24F 6/043 | 261/99 |
| 10,168,064 | B1 * | 1/2019 | Zhang | F24F 6/12 | |
| 10,900,677 | B2 * | 1/2021 | Chen | F24F 6/06 | |
| 11,333,377 | B2 * | 5/2022 | Yang | F24F 13/06 | |
| 2003/0164559 | A1 * | 9/2003 | Rhea | F24F 6/00 | 261/66 |
| 2005/0067723 | A1 * | 3/2005 | Parker | F24F 6/043 | 261/104 |
| 2008/0093750 | A1 * | 4/2008 | Wang | F24F 6/00 | 261/66 |
| 2008/0127820 | A1 * | 6/2008 | Park | A61L 9/122 | 55/438 |
| 2009/0139408 | A1 * | 6/2009 | Kang | F24F 8/108 | 96/366 |
| 2009/0314164 | A1 * | 12/2009 | Yamashita | F24F 6/043 | 96/245 |
| 2012/0164935 | A1 * | 6/2012 | Ha | F24F 6/06 | 454/337 |
| 2014/0083524 | A1 * | 3/2014 | Huang | F24F 6/00 | 137/409 |
| 2014/0145355 | A1 * | 5/2014 | Shimizu | F24F 6/06 | 261/30 |
| 2014/0264963 | A1 * | 9/2014 | Barker | F24F 13/00 | 261/37 |
| 2015/0021795 | A1 * | 1/2015 | Bae | F24F 6/00 | 261/119.1 |
| 2015/0330643 | A1 * | 11/2015 | Lee | F24F 6/06 | 210/243 |
| 2016/0146502 | A1 * | 5/2016 | Kim | F24F 3/1405 | 165/110 |
| 2016/0305674 | A1 * | 10/2016 | Kim | F24F 11/74 | |
| 2018/0128507 | A1 * | 5/2018 | Hitzler | C02F 1/68 | |
| 2019/0072289 | A1 * | 3/2019 | Lai | B01F 23/20 | |
| 2019/0226696 | A1 * | 7/2019 | Kim | F24F 6/04 | |
| 2019/0383503 | A1 * | 12/2019 | Kim | F24F 6/16 | |
| 2020/0191417 | A1 * | 6/2020 | Chen | F24F 7/007 | |
| 2021/0080147 | A1 * | 3/2021 | Kohama | F24F 13/08 | |
| 2021/0088075 | A1 * | 3/2021 | Bae | F24F 1/0087 | |
| 2021/0172628 | A1 * | 6/2021 | Park | B01F 23/215 | |
| 2022/0082274 | A1 * | 3/2022 | Kim | F24F 6/04 | |
| 2022/0243934 | A1 * | 8/2022 | Kim | B01D 46/0049 | |
| 2022/0381456 | A1 * | 12/2022 | Chen | F24F 6/12 | |
| 2023/0093557 | A1 * | 3/2023 | Hong | F24F 11/0008 | 96/257 |

FOREIGN PATENT DOCUMENTS

| | | | | | |
|---|---|---|---|---|---|
| CN | 101936586 | A | | 1/2011 | |
| CN | 206310047 | U | * | 7/2017 | F16K 31/18 |
| CN | 104603547 | B | * | 11/2017 | F24F 13/24 |
| CN | 108825803 | A | * | 11/2018 | F16K 1/32 |
| CN | 108825804 | A | * | 11/2018 | F16K 1/32 |
| CN | 108870615 | A | * | 11/2018 | A61L 9/122 |
| CN | 111238020 | A | * | 6/2020 | F16K 21/18 |
| CN | 211876216 | U | * | 11/2020 | F16K 21/18 |
| CN | 215765632 | U | * | 2/2022 | |
| EP | 3081872 | A1 | * | 10/2016 | F16K 21/18 |
| EP | 3913291 | A4 | * | 11/2021 | F24F 6/04 |
| JP | 56-15930 | U | | 2/1981 | |
| JP | 60-108930 | U | | 7/1985 | |
| JP | 2000-074426 | A | | 3/2000 | |
| JP | 2000-266369 | A | | 9/2000 | |
| JP | 2000-283508 | A | | 10/2000 | |
| JP | 2007-309610 | A | | 11/2007 | |
| JP | 2008-64429 | A | | 3/2008 | |
| JP | 6397756 | B2 | * | 9/2018 | |
| JP | 2022-537852 | A | | 8/2022 | |
| KR | 1998-062368 | U | | 11/1998 | |
| KR | 10-0320853 | B1 | | 1/2002 | |
| KR | 10-0558273 | B1 | | 3/2006 | |
| KR | 20-0441640 | Y1 | | 8/2008 | |
| KR | 200441640 | | * | 8/2008 | |
| KR | 2011092928 | A | * | 8/2011 | F24F 6/12 |
| KR | 10-2012-0113026 | A | | 10/2012 | |
| KR | 20120113026 | | * | 10/2012 | |
| KR | 10-2016-0068115 | A | | 6/2016 | |
| KR | 10-2016-0082375 | A | | 7/2016 | |
| KR | 10-2016-0083173 | A | | 7/2016 | |
| KR | 2017127266 | A | * | 11/2017 | F16K 15/14 |
| WO | WO 2012/091369 | A2 | | 7/2012 | |
| WO | WO-2017149798 | A1 | * | 9/2017 | F24F 6/04 |
| WO | WO-2018113414 | A1 | * | 6/2018 | F16K 31/18 |
| WO | WO-2020141796 | A2 | * | 7/2020 | F24F 11/0008 |
| WO | WO-2021194277 | A1 | * | 9/2021 | B01D 46/0027 |
| WO | WO-2023034611 | A1 | * | 3/2023 | A61M 16/203 |

OTHER PUBLICATIONS

Epo translation of KR 200441640 (Year: 2008).*
"RS Rack & Pinion Actuator" Bimba published 2017 accessed at <https://airinc.net/wp-content/uploads/2018/12/Bimba_ElectricActuators_RSRackPinionElectricActuators.pdf> (Year: 2017).*
"Magnet" Wikipedia published May 30, 2017 accessed at <https://en.wikipedia.org/w/index.php?title=Magnet&oldid=782949282> (Year: 2017).*
Epo translation of CN101936586 (Year: 2011).*
"Uninterruptible power supply" Wikipedia published Mar. 28, 2017 accessed at <https://en.wikipedia.org/w/index.php?title=Uninterruptible_power_supply&oldid=772601331> (Year: 2017).*
Combined Chinese Office Action and Search Report dated Aug. 2, 2022 in Chinese Patent Application No. 201980087697.1 (with unedited computer generated English Translation), 18 pages.
Extended European Search Report dated Jan. 31, 2022 in European Patent Application No. 19906919.6, 9 pages.
International Search Report dated Apr. 7, 2020 in PCT/KR2019/018481 filed on Dec. 26, 2019, 3 pages.
Office Action dated Oct. 3, 2023, issued in corresponding Japanese patent application No. 2020-572813.

* cited by examiner

HUMIDIFIER

TECHNICAL FIELD

The present disclosure relates to a humidifier for increasing humidity in air, and more particularly, to a vaporization-type (blowing-type) humidifier performing humidification by vaporizing water through a humidification filter (a humidification member).

BACKGROUND ART

In general, a humidifier artificially generating and releasing moisture to increase indoor humidity includes a heating-type humidifier using a method of spraying water vapor generated by heating water stored in a water tank to a predetermined temperature according to a method of generating moisture indoors, an ultrasonic-type humidifier using a method of ultrasonically vibrating stored water in a water tank to release fine water particles indoors, and a combination-type humidifier equipped with a heating-type humidification method and an ultrasonic-type humidification method at the same time.

Recently, a vaporization-type (a blowing-type) humidifier using methods such as vaporizing water moved to an upper side of the humidification filter by blowing after immersing the humidification filter (the humidification member), or rotating a part of the humidification filter made of a plurality of disks in a state of being immersed in a water tank to vaporize water attached to a surface of the disk by blowing, are also used.

In general, in the case of a vaporization-type humidifier, as a blowing fan intakes outside air, the air intaken by the blowing fan is atomized while passing through the humidification filter. Atomized air is discharged through an air outlet of the humidifier, to humidify a dry room.

This vaporization-type humidifier uses a water tank accommodating water supplied from the water tank, and the humidification filter is immersed in the water stored in the water tank.

In the case of a conventional vaporization-type humidifier, there is a problem in that even after humidification is complete, water may remain in the water container, causing mold or scale, water scale, or bacterial growth in the water tank.

In addition, in the case of a conventional vaporization-type humidifier, there may be a problem that humidification is performed by the water stored in the water tank even when humidification is not desired.

In the case of a conventional vaporization-type humidifier, there may be a problem in that cleaning is difficult due to parts installed in the water tank.

DISCLOSURE

Technical Problem

The present disclosure has been devised to solve at least a portion of the problems of the prior art as described above, and an aspect of the present disclosure is to provide a humidifier capable of blocking a supply of water to a water tank when humidification is not desired or when humidification is complete.

An aspect of the present disclosure is to provide a humidifier that can be easily cleaned.

An aspect of the present disclosure is to provide a humidifier capable of preventing water from remaining in a water tank.

An aspect of the present disclosure is to provide a humidifier capable of adjusting a water level supplied to a water tank.

An aspect of the present disclosure is to provide a humidifier that can be safely used even when a power supply to the humidifier is cut off.

Technical Solution

According to an aspect of the present disclosure, a humidifier is provided. The humidifier includes: a water tank which is installed inside a housing and stores water; a humidification member which is immersed in the water stored in the water tank and performs humidification; a water container provided with an opening/closing valve which is opened and closed to supply water stored therein to the water tank; a water container support member which is detachably mounted on an upper portion of the water tank and on which the water container is seated; and a water supply control member which is mounted on the water container support member and opens and closes the opening/closing valve so that the water can be supplied from the water container to the water tank.

In addition, the water supply control member includes a shaft mounted on the water container support member, a lifting and lowering unit formed to extend to one side of the shaft and moved to ascend and descend to press the opening/closing valve, and an operating unit formed to extend to the other side of the shaft. The lifting and lowering unit may be rotated about the shaft as an axis and ascend and descend, according to the movement of the operating unit.

The water container support member may include a rotation support unit on which the shaft is rotatably installed.

In addition, according to an aspect of the present disclosure, the humidifier may further include a driving unit for rotating the operating unit of the water supply control member about the shaft. In this case, the driving unit may be disposed in the housing.

The water supply control member may include a protrusion unit formed upwardly of the operation unit to protrude, and a contact member in contact with the protrusion unit to slidably move so that the lifting and lowering unit rises, and the driving unit may be configured to slidably move the contact member. In this case, the driving unit may include a driving gear that is rotated by a motor and engaged with a rack gear unit formed on the contact member.

In addition, as another embodiment, a first magnet member may be installed in the operating unit, the driving unit may include a second magnet member applying attractive force to the first magnet member. In this case, the driving unit may include a wheel member rotating about a wheel shaft, and the second magnet member may be configured to approach or to be moved away from the first magnet member as it is installed on the wheel member and rotates about the wheel shaft.

In addition, as an aspect of the present disclosure, a humidifier is provided. The humidifier includes: a water tank installed inside a housing, and storing water thereinside; a humidification member immersed in the water stored in the water tank and performing humidification; a water container provided with an opening/closing valve which is opened and closed to supply water stored therein to the water tank; and a water supply control member mounted on a base unit of the housing and configured to open and close the opening/ closing valve by magnetic force so that water can be supplied from the water container to the water tank.

In this case, a magnetic force member is mounted on a front end of the opening/closing valve, and the water supply control member may include a solenoid magnet mounted on the base unit, and may be configured to open the opening/closing valve as magnetic force is applied to the solenoid magnet.

The opening/closing valve may include a cap member coupled to an inlet of the water container, a sealing member for sealing an outlet formed in the cap member, a rod member for lifting and lowering the sealing member, and an elastic member for providing elastic force to seal the outlet of the cap member.

In addition, the humidifier according to an aspect of the present disclosure may further include: a water level sensor for measuring a water level within in the water tank; and a control unit configured to control movement of the water supply control member to open and close the opening/closing valve according to the water level detected by the water level sensor.

In addition, the humidifier according to an aspect of the present disclosure may further include: an auxiliary power supply unit for supplying reserve power when a power supply is cut off; and a control unit for controlling the movement of the water supply control member, wherein the control unit may be configured to return the water supply control member to an initial position using power of the auxiliary power supply unit so that the opening/closing valve is in a closed state when the power supply is cut off.

In addition, the humidifier according to an aspect of the present disclosure further includes: a blowing unit proving blowing force so that air introduced from an air inlet flows to an air outlet through the humidification member; a guide unit for guiding an user to an abnormal state; and a control unit for controlling driving of the blowing unit, wherein the control unit may guide the user so that the user can empty the water tank after a predetermined time has elapsed after the driving of the blowing unit is finished through the guide unit.

The humidifier according to an aspect of the present disclosure may further include an air purifying filter for purifying the air introduced from an air inlet.

Advantageous Effects

According to an embodiment of the present disclosure, when humidification is not desired or when humidification is complete, a water supply (a supply of water?) to the water tank may be blocked through the water supply control member, thereby contributing to the user's convenience.

In addition, according to an embodiment of the present disclosure, since the water supply control member does not exist on an inner surface of the water tank, it is possible to obtain an effect that the water tank may be easily cleaned.

According to an embodiment of the present disclosure, it is possible to prevent water from remaining in the water tank, so that it is possible to obtain an effect of minimizing occurrence or proliferation of water scale, scale, mold, bacteria, or the like, in the water tank.

In addition, according to an embodiment of the present disclosure, there is an effect that the water level supplied to the water tank can be properly maintained.

According to an embodiment of the present disclosure, even when power supply to the humidifier is cut off, the water supply to the water tank may be stopped, so that safety accidents such as electric shock or fire can be prevented.

BEST MODE FOR INVENTION

Figure 1:
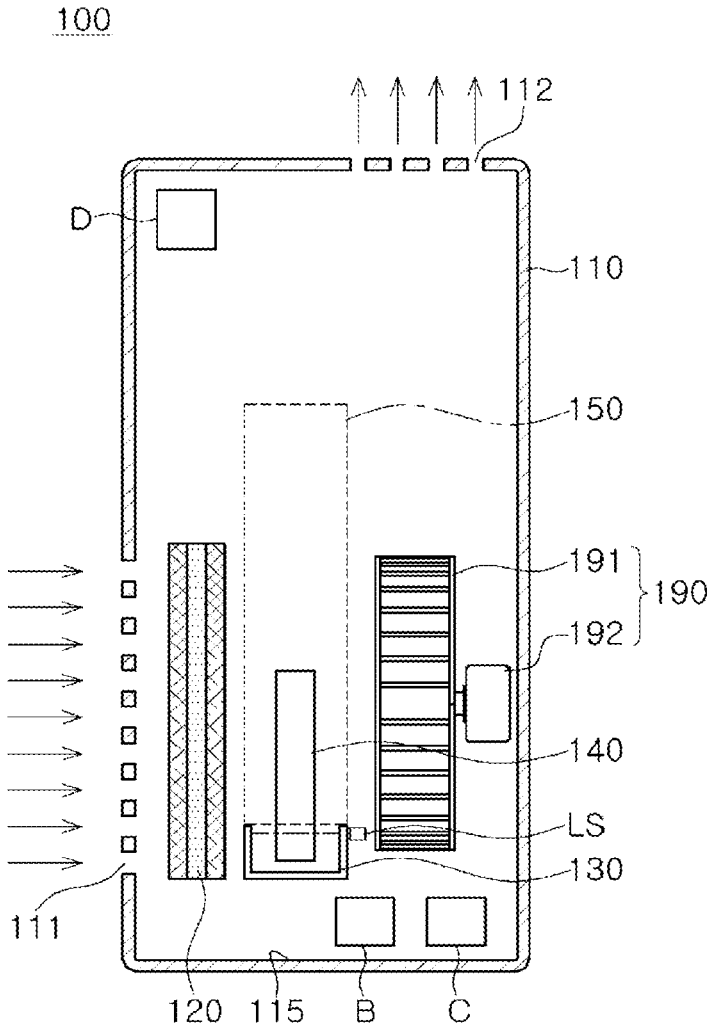
FIG. 1 is a schematic view illustrating a side surface of a humidifier according to an embodiment of the present disclosure.

Hereinafter, embodiments in the present disclosure will be described hereinafter with reference to the accompanying drawings. The disclosure may, however, be exemplified in many different forms and should not be construed as being limited to the specific embodiments set forth herein. Rather, these embodiments are provided so that this disclosure will be thorough and complete, and will fully convey the scope of the invention to those skilled in the art. In the drawings, the same reference numerals will be used throughout to designate the same or like elements, and the shapes and dimensions of elements may be exaggerated for clarity.

In addition, the same reference numerals will be used throughout the drawings for elements having the same or similar functions and operations.

Hereinafter, embodiments of the present disclosure will be described with reference to the drawings.

First, a humidifier according to an embodiment of the present disclosure will be described with reference to FIGS. 1 to 6.

Figure 2:
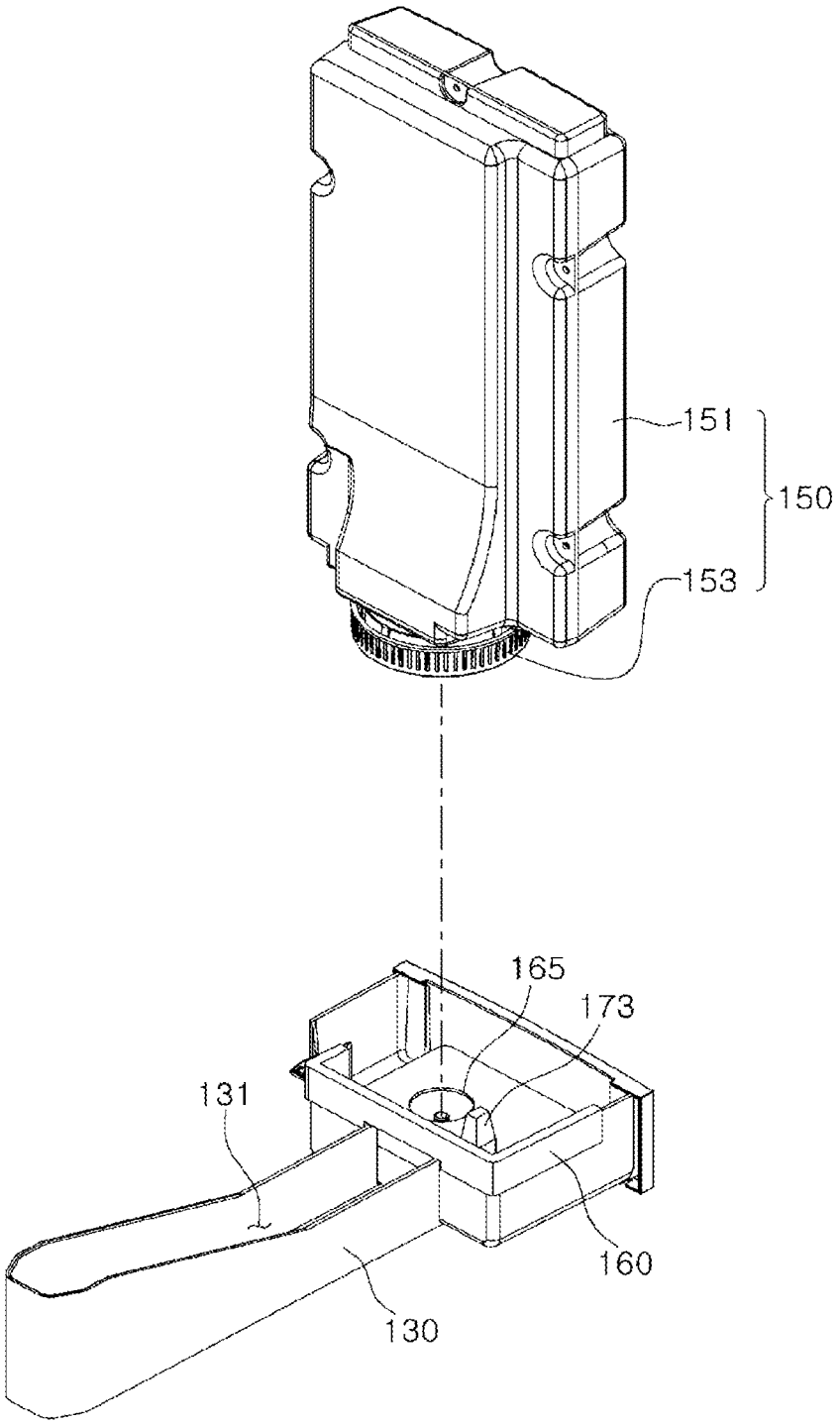
FIG. 2 is a perspective view of a water container, a water container support member, and a water tank provided in the humidifier according to an embodiment of the present disclosure.
Figure 3:
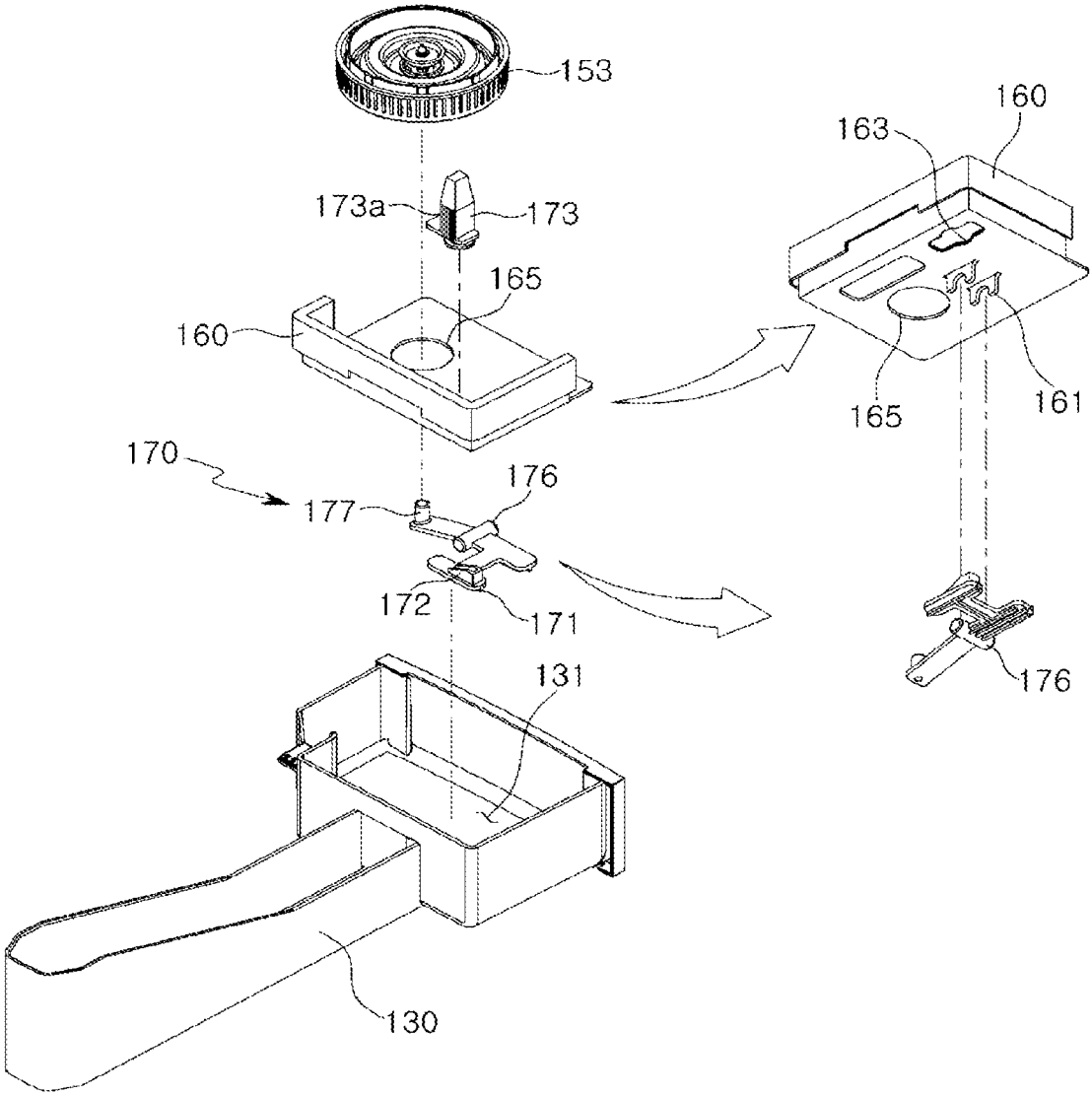
FIG. 3 is an exploded perspective view of the water container support member and the water tank shown in FIG. 2.
Figure 4:
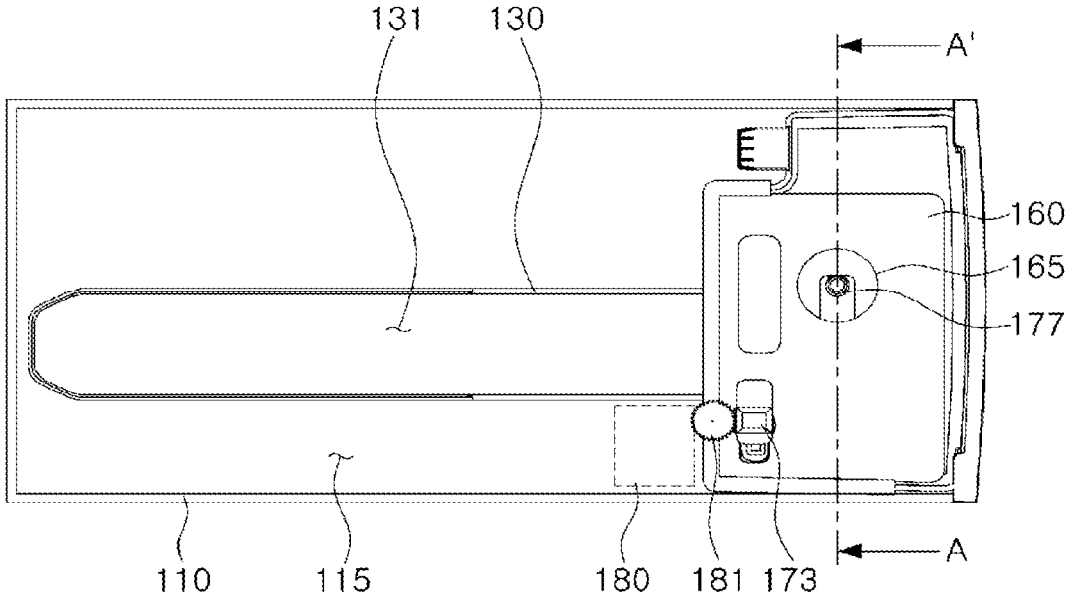
FIG. 4 is a plan view showing the water tank support member and the tank shown in FIG. 3.
Figure 5:
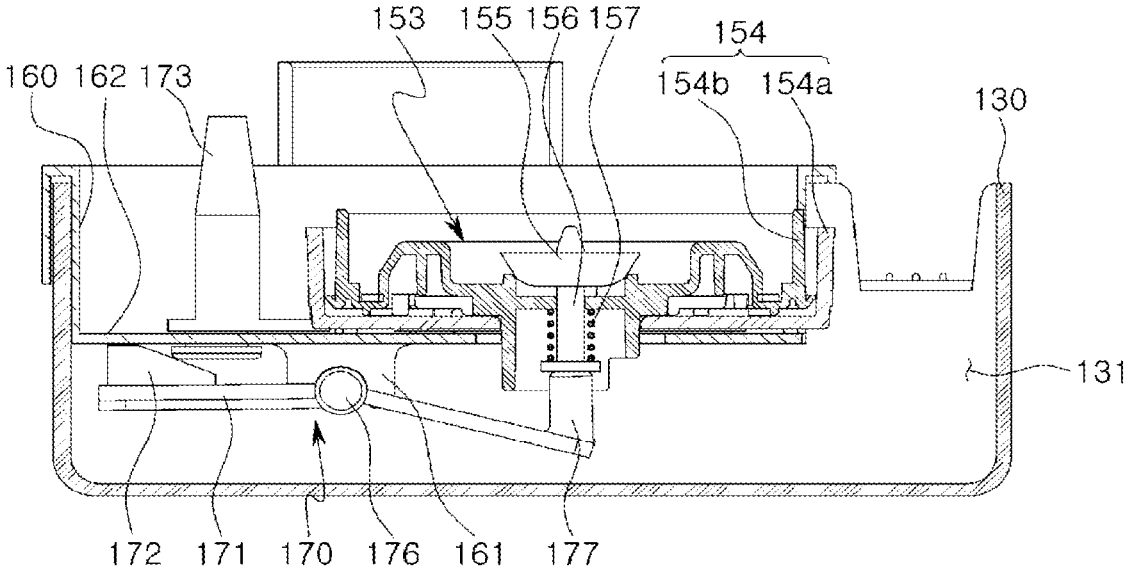
FIG. 5 is a cross-sectional view taken along line A-A' of FIG. 4, showing a closed state of an opening/closing valve.
Figure 6:
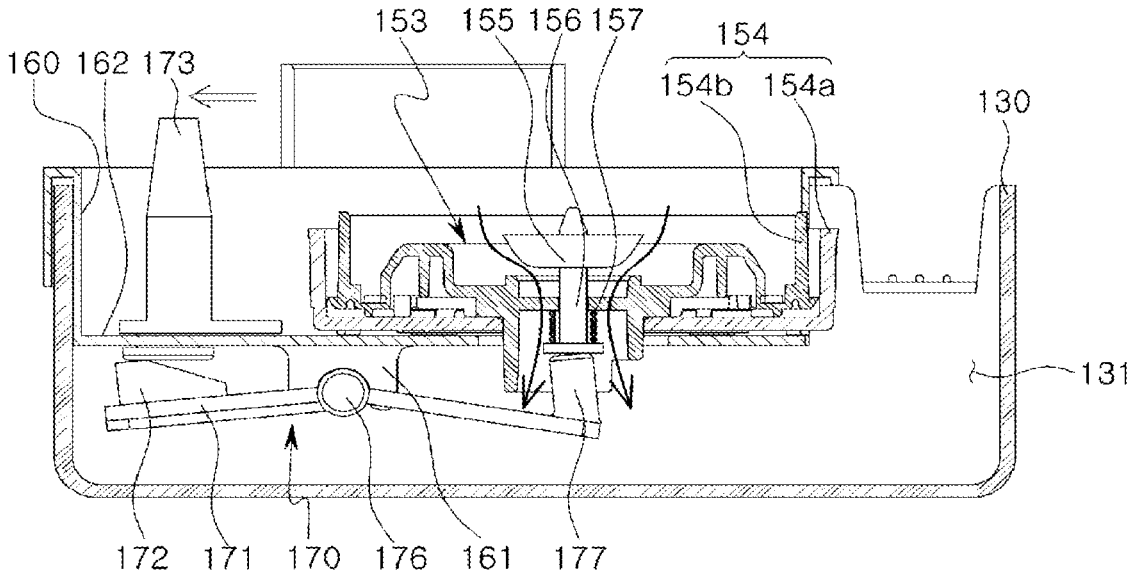
FIG. 6 is a cross-sectional view taken along line A-A' of FIG. 4, showing an open state of an opening/closing valve.

FIG. 1 is a schematic view illustrating a side surface of a humidifier according to an embodiment of the present disclosure, FIG. 2 is a perspective view of a water container provided in a humidifier, a water container support member, and a water tank according to an embodiment of the present disclosure, and FIG. 3 is an exploded perspective view of the water container support member and the water tank shown in FIG. 2, FIG. 4 is a plan view illustrating the water container support member and the water tank shown in FIG. 3, and FIGS. 5 and 6 are cross-sectional views taken along line A-A' of FIG. 4, showing that an opening/closing valve is in a closed state and an open state, respectively.

As shown in FIGS. 1 to 6, a humidifier 100 according to an embodiment of the present disclosure includes a housing 110 forming an exterior of a product, a water tank 130 in which water is stored, a humidification member 140 for performing humidification, a water tank 150 having an opening/closing valve 153 for supplying water to the water tank 130, a water container support member 160 on which the water container 150 is seated, and a water supply control member 170 opening and closing the opening/closing valve 153. A driving unit 180 for driving the water supply control member 170, an air purifying filter 120, a blowing unit 190, a control unit (C), a water level sensor (LS), an auxiliary power unit (B), and a guide unit (D) may be further included.

First, the housing 110 may constitute an exterior of the humidifier 100 according to an embodiment of the present disclosure, and may include an air inlet 111 through which external air is intaken into the housing 110, and an air outlet 112 from which internal air is discharged externally. As shown in FIG. 1, the air inlet 111 may be installed on a front surface of the housing 110, and the air outlet 112 may be installed on an upper surface of the housing 110, but an installation position and number of the air inlet 111 and the outlet 112 can be variously changed. For example, the air inlet 111 may be installed on at least a portion of front, rear, left, and right surfaces of the housing 110 so as to suck air in various directions, and a plurality of air outlets 112 may also be installed.

In addition, an air purifying filter 120 may be provided inside the housing 110 to filter (purify) air introduced from the air inlet 111.

The air purifying filter 120 may be installed on a front surface of the blowing unit 190 so that the air introduced from the air inlet 111 may be filtered by the air purifying filter 120 and then flow into the blowing unit 190, but the installation location thereof is not limited.

For example, the air purifying filter 120 may be disposed in an air flow passage at a rear end of the air inlet 111. The air purifying filter 120 may be configured in a rectangular shape corresponding to a shape and a cross-sectional area of the air flow passage, and thereby, the entire amount of air introduced through the air inlet 111 of the housing 110 may pass through the air purifying filter 120. However, the shape of the air purifying filter 120 is not limited thereto, and various known filters may be used. For example, the air purifying filter 120 may be formed of a three-dimensional filter having a circular or square cross-section and having a space formed therein.

In addition, the air purifying filter 120 may be selected from filters having various shapes and functions, and the type, number, shape, and the like, of the filters are not limited to the example shown in FIG. 1, and various changes are possible.

The blowing unit 190 provides blowing force so that the air introduced from the air inlet 111 flows to the air outlet 112 through the humidification member 140. An air flow passage through which air flows by driving the blowing unit 190 is formed between the air inlet 111 and the air outlet 112, and this air flow path can be variously changed according to the positions of the air inlet 111 and the air outlet 112, and the intaken/discharge position and direction of the blowing unit 190.

In addition, the blowing unit 190 includes a blowing fan 191 for flowing air, and a fan motor 192 for driving the blowing fan 191. As shown in FIG. 1, the blowing fan 191 may have a structure disposed at a rear side of the air purifying filter 120 based on the air flow path and intaken from one side, but the installation position and intaken structure thereof are not limited to the illustration of FIG. 1 and various modifications are possible. For example, the blowing fan 191 may also have a double intaken structure.

The water tank 130 is installed inside the housing 110 and includes a water accommodation space 131 for accommodating water.

In addition, a water level sensor LS may be installed in the water tank 130 to detect a water level of the water stored in the water tank 130. The water level sensor LS may be configured to measure a full water level indicating a state in which the water tank 130 is full of water or a low water level indicating a state in which the water tank 130 is empty. Such a water level sensor LS may be installed inside the water tank 130, but when the water level sensor LS is installed outside of the water tank 130 for easy cleaning of the water tank 130 and the water tank 130 is coupled, it may be configured to measure the water level using capacitance, or the like.

The humidification member 140 is immersed in the water stored in the water accommodation space 131 of the water tank 130 to absorb water to perform humidification. That is, the air flow generated by an operation of the blowing unit 190, which will be described later, is humidified while passing through the humidification member 140. The humidification member 140 may be configured to have a material or shape having excellent hygroscopicity so as to sufficiently absorb the water stored in the water tank 130. However, the humidification member 140 is not limited to a hygroscopic material or shape, and various types of humidification members used in known vaporization-type humidifiers, such as a disk-shaped member, may be used.

In addition, the water container 150 is configured to store water in an internal space formed in a water container body 151 to supply water to the humidification member 140. The water container 150 may have a structure that is separated from the humidifier 100 to easily fill an inside of the water container 150 with water, but is not limited thereto.

The water container 150 may include an opening/closing valve 153 that opens and closes to supply the water stored in the water container body 151 to the water tank 130. This opening/closing valve 153 may be installed in a cap structure screwed to an inlet of the water container 150, and may have a mechanical valve structure.

For example, as shown in FIGS. 5 and 6, the opening/closing valve 153 may include a cap member 154 coupled to the inlet of the water container 150, a sealing member 155 for opening or sealing an outlet formed in the cap member 154, a rod member 156 for ascending and descending the sealing member 155 in a vertical direction, and an elastic member 157 providing elastic force so that the sealing member 155 seals an outlet of the cap member 154. Meanwhile, although the cap member 154 is illustrated as having a double structure including two caps 154*a* and 154*b* in FIGS. 5 and 6, the cap member 154 may also be formed of a single member.

In addition, the water container support member 160 is detachably installed on an upper portion of the water tank 130, and allows the water container 150 to be seated on a seating surface 162 when the water container 150 is installed in the water tank 130. That is, as shown in FIGS. 5 and 6, a lower surface of the opening/closing valve 153 of the water container 150 may be supported on the seating surface 162 of the water container support member 160. Since the water container support member 160 is detachable from an upper portion of the water tank 130, a cleaning operation of the water tank 130 may be easily performed.

The water supply control member 170 is installed on the water container support member 160 and is configured to open and close the opening/closing valve 153 so that water can be supplied from the water container 150 to the water tank 130. This water supply control member 170 is not installed on the bottom surface of the water tank 130, but is installed on the water container support member 160, detachable from the water tank 130, so that it does not affect the cleaning of the water tank 130.

As an example, referring to FIGS. 3 to 6, the water supply control member 170 may include a shaft 176 rotatably installed on the water container support member 160, a lifting and lowering pressing unit 177 that is formed to extend to one side of the shaft 176 moves to ascend and descend to press the rod member 156 of the opening/closing valve 153, and an operating unit 171 formed to extend to the other side of the shaft 176. In this case, the shaft 176 may be rotatably installed on a rotation support unit 161 formed on a lower surface of the water container support member 160, and may have a structure separated from the rotation support unit 161 for cleaning. In addition, since the rod member 156 is positioned on the lower surface of the water container support member 160 through the through-hole 165 formed in the water container support member 160, it may be pressed by the lifting and pressing unit 177.

As described above, as the operating unit 171 moves in a vertical direction, as the operation unit 171 moves in the vertical direction, the lifting and lowering pressing unit 177 moves to ascend and descend while rotating the shaft 176 as an axis, thereby, the lifting and lowering pressing unit 177 presses the rod member 156 of the opening/closing valve 153 to open the outlet of the cap member 154.

The driving unit 180 is configured to rotate the operating unit 171 of the water supply control member 170 about the shaft 176. The driving unit 180 may be disposed in the housing 110 because power supply is required to move the operating unit 171. That is, by installing the driving unit 180 in a base unit 115 of the housing 110, adjacent to the water tank 130, a separation operation of the water tank 130 for cleaning does not affect the driving unit 180.

An example of the operation of the driving unit 180 and the operating unit 171 of the water supply control member 170 will be described with reference to FIGS. 3 to 6.

The water supply control member 170 includes a protrusion unit 172 formed to protrude upwardly of the operating unit 171, and a contact member 173, which slidably moves to come into contact with the protrusion unit 172.

The contact member 173 is configured to be exposed to an upper side of the water container support member 160 through a mounting opening 163 formed in the water container support member 160, and a rack gear unit 173*a* is formed on one side of the contact member 173.

In addition, the driving unit 180 includes a driving gear 181 that is rotated by a motor (not shown), and may be configured such that the driving gear 181 is engaged with a rack gear unit 173*a* of the contact member 173 and rotates to slidably move the contact member 173.

Referring to FIG. 5, in a state in which a lower side of the contact member 173 does not come into contact with the protrusion unit 172 of the operating unit 171, since the lifting and lowering pressing unit 177 does not press the rod member 156 of the opening/closing valve 153, the sealing member 155 seals the outlet of the cap member 154, and the water in the water container 150 is not supplied to the water tank 130.

Referring to FIG. 6, together with FIGS. 2 to 4, when the driving unit 180 is operated in the closed state of the opening/closing valve of FIG. 5, the driving gear 182 is rotated by a motor (not shown). Accordingly, the contact member 173 having the rack gear unit 173*a*, engaged with the driving gear 182 is slidably moved (a downward direction in FIG. 4, an arrow direction in FIG. 6). The contact member 173, which slidably moves comes into contact with the protrusion unit 172 of the operating unit 171 to move the operating unit 171 in a downward direction, and accordingly, the lifting and lowering pressing unit 177 moves upwardly about the shaft 176 to press the rod member 156 of the opening/closing valve 153. Thereby, the sealing member 155 opens the outlet of the cap member 154, and water from the water container 150 is supplied to the water tank 130.

As described above, by performing opening and closing of the opening/closing valve 153 through the configuration of the driving unit 180 and the water supply control member 170, it is possible to control the supply of water from the water container 150 to the water tank 130.

Meanwhile, the humidifier according to an embodiment of the present disclosure may include a control unit (C) for controlling driving of the driving unit 180 to move the water supply control member 170. The control unit (C) is configured to move the water supply control member 170 by controlling driving of the driving unit 180 to open and close the opening/closing valve 153 according to a water level detected by the water level sensor LS.

For example, when the water level detected by the water level sensor LS corresponds to a full water level of the water tank 130, the control unit C may control the driving of the driving unit 180 to close the opening/closing valve 153 to block water supply to the water tank 130. Conversely, when the water level sensed by the water level sensor LS corresponds to a low water level of the water tank 130, the control unit C may control the driving of the driving unit 180 to open the opening/closing valve 153 such that water may be supplied to the water tank 130.

Meanwhile, when the power is cut off while the opening/closing valve 153 is opened, since the water supply from the water container 150 to the water tank 130 continues, when power is re-supplied to the humidifier 100, safety accidents such as electric shock or fire may occur. In order to solve this problem, the humidifier 100 according to an embodiment of the present disclosure may include an auxiliary power supply unit (B) for supplying reserve power when the power supply is cut off, and when the power supply to the humidifier 100 is cut off, the control unit (C) may be configured to move the water supply control member 170 to an initial position such that the opening/closing valve 153 is closed, by controlling the driving of the driving unit 180 using the power of the auxiliary power unit (B).

In addition, the humidifier 100 according to an embodiment of the present disclosure may further include a guide unit (D) for guiding an user to an abnormal state of the humidifier. The guide unit (D) can guide the user through visual or auditory guidance when a malfunction occurs in the humidifier 100, when water supply to the water tank 150 is required because the water tank 130 is empty, or the like.

Meanwhile, if a considerable period of time elapses while the water tank 130 is filled with water, since water scale, scale, mold, bacteria, or the like may occur in the water tank 130, the control unit C may be configured to drive the blowing unit 190 for a predetermined time after the use of the humidifying function is finished to remove the water absorbed in the humidification member 140 or the water stored in the water tank 130.

In addition, the control unit (C) may guide the user through the guide unit (D) to empty the water tank after a predetermined time has elapsed after the driving of the blowing unit is finished.

Next, a water supply control member 170 and a driving unit 180 according to another embodiment of the present disclosure will be described with reference to FIGS. 7 to 9.

Figure 7:
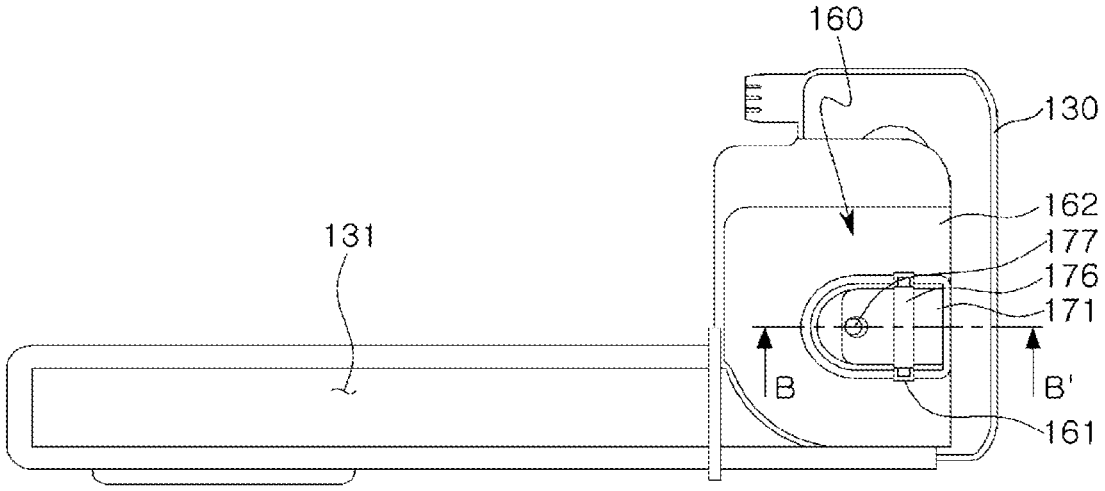
FIG. 7 is a plan view illustrating a water container support member and a water tank according to another embodiment of the present disclosure.
Figure 8:
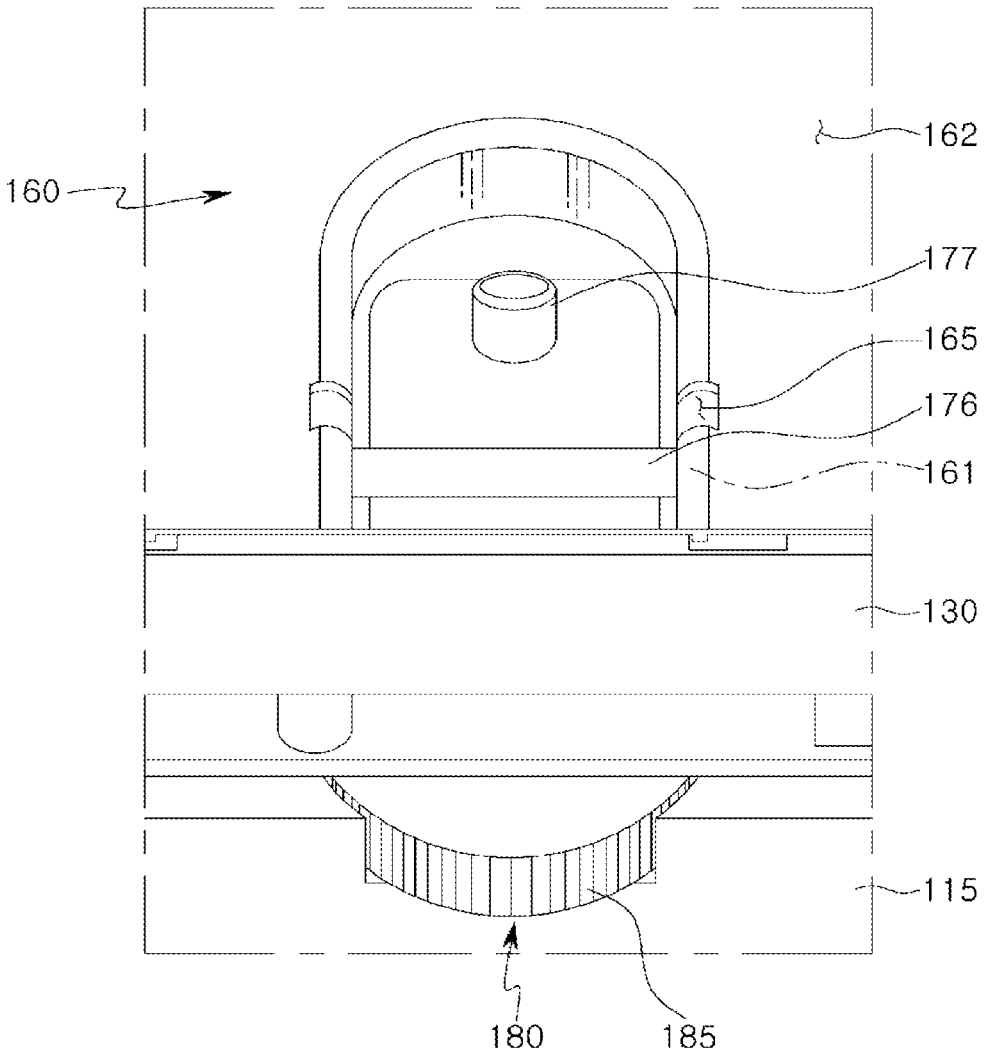
FIG. 8 is a perspective view illustrating a water supply control member and a driving unit in the water tank shown in FIG. 7.
Figure 9:
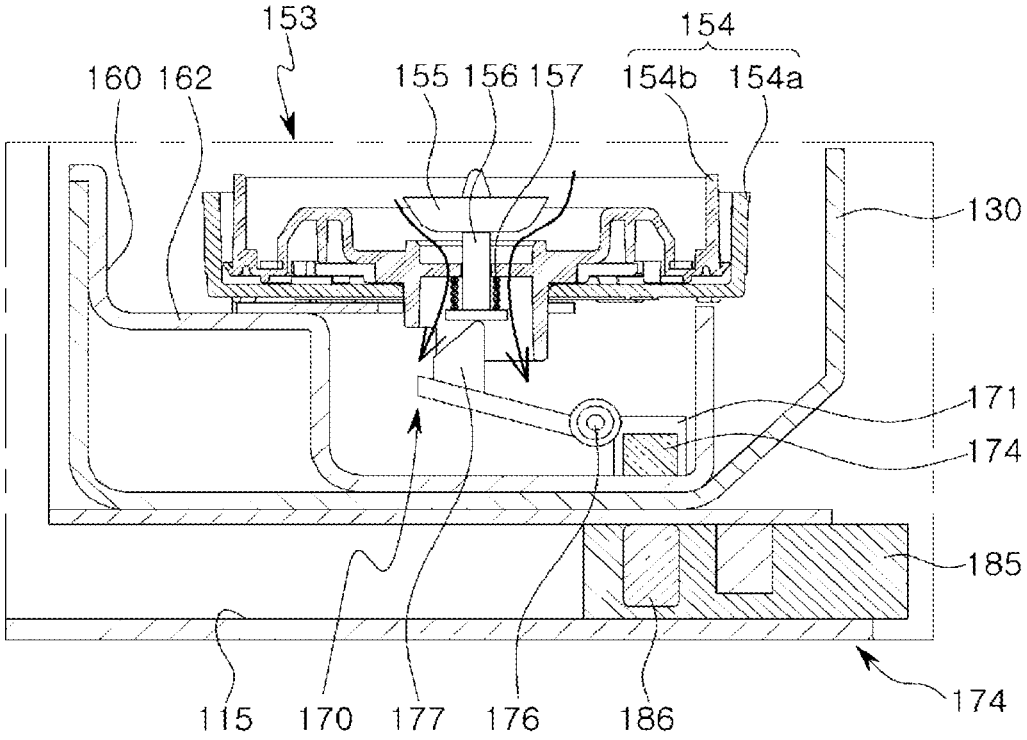
FIG. 9 is a cross-sectional view taken along the line B-B' of FIG. 7, showing an open state of an opening/closing valve.

FIG. 7 is a plan view illustrating a water container support member and a water tank according to another embodiment of the present disclosure, FIG. 8 is a perspective view illustrating a water supply control member and a driving unit in the water tank portion shown in FIG. 7, and FIG. 9 is a cross-sectional view taken along the line B-B', showing a state in which an opening/closing valve is opened.

In the case of the embodiment shown in FIGS. 7 to 9, the remainder of the configuration except for a water container support member 160, a water supply control member 170, and a driving unit 180 is the same as the humidifier 100 described through FIGS. 1 to 6, a detailed description thereof will be omitted.

In the case of FIGS. 7 to 9, the water supply control member 170 is installed on a seating surface 162 of the water container support member 160, and is configured to open and close an opening/closing valve 153 so that water can be supplied from the water container 150 to the water tank 130. The water supply control member 170 is not installed on a bottom surface of the water tank 130, but is installed on the water container support member 160 which is detachable from the water tank 130, so that it does not affect cleaning of the water tank 130.

Referring to FIGS. 7 to 9, the water supply control member 170 may include a shaft 176 rotatably installed on the water container support member 160, a lifting and lowering pressing unit 177 formed to extend to one side of the shaft 176 and moves to ascend and descend to press a rod member 156 of opening/closing valve 153, and an operating unit 171 formed to extend to the other side of the shaft 176. In this case, the shaft 176 may be rotatably installed on a rotation support unit 161 formed on a side surface of the water container support member 160, and may have a structure separated from the rotation support unit 161 for cleaning. In addition, a through-hole 165 may be formed on the side surface of the water container support member 160 such that water discharged from the water container 150 to the water tank 130 when the opening/closing valve 153 is opened.

As described above, as the operating unit 171 moves in a vertical direction, the lifting and lowering pressing unit 177 ascends and descends while rotating the shaft 176 as an axis to press a rod member 156 of the opening/closing valve 153 to open an outlet of the cap member 154.

The driving unit 180 is configured to rotate the operating unit 171 of the water supply control member 170 about the shaft 176. The driving unit 180 may be disposed in the housing 110 because power supply is required to move the operating unit 171. That is, by installing the driving unit 180 in the base unit 115 of the housing 110, adjacent to the water tank 130, a separation operation of the water tank 130 for cleaning does not affect the driving unit 180.

Referring to FIGS. 7 to 9, a first magnet member 174 may be installed in the operating unit 171, and the driving unit 180 may include a wheel member 185 rotating about a wheel axis, and a second magnet member 186 installed in the first magnet member 185 and applying attractive force to the first magnet member 174.

Accordingly, as the wheel member 185 rotates about the wheel axis, the second magnet member 186 approaches or moves to be away from the first magnet member 174. In this case, as shown in FIG. 9, when the second magnet member 186 is positioned below the first magnet member 174, attractive force acts between the second magnet member 186 and the first magnet member 174 so that the operating unit moves downwardly, and accordingly, the lifting and pressing unit 177 rotates about the shaft 176 to press the rod member 156 of the opening/closing valve 153 to open an outlet of the cap member 154.

The wheel member 185 may be configured to rotate by a motor (not shown) driven by a control unit C, and accordingly, the control unit C may control a supply of water from the water container 150 to the water tank 130 by performing opening and closing of the opening/closing valve 153 through the configuration of the driving unit 180 and the water supply control member 170.

Finally, a water supply control member 170 and a driving unit 180 according to another embodiment of the present disclosure will be described with reference to FIG. 10.

Figure 10:
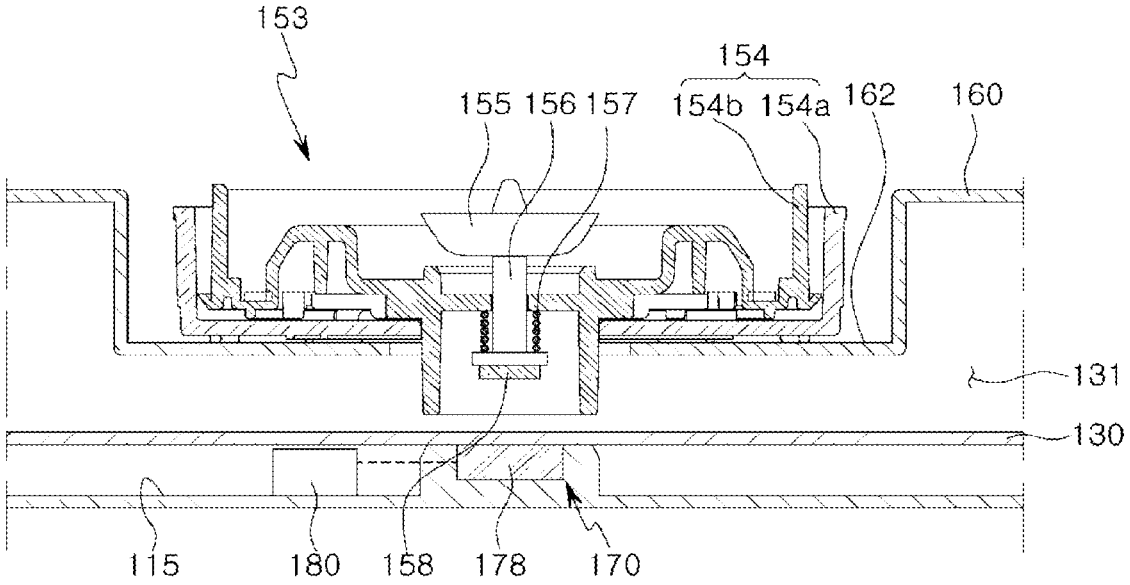
FIG. 10 is a cross-sectional view illustrating an opening/closing structure of an opening/closing valve according to another embodiment of the present disclosure.

FIG. 10 is a cross-sectional view illustrating an opening and closing structure of an opening/closing valve according to another embodiment of the present disclosure.

In the case of an embodiment shown in FIG. 10, the remainder of the configuration except for the water tank support member 160, the water supply control member 170, and the driving unit 180 is the same as the humidifier 100 described with reference to FIGS. 1 to 6, so a description thereof will be omitted.

In the case of the embodiment shown in FIG. 10, the water supply control member 170 is installed on a base unit 115 of a housing 110 and is configured to open and close an opening/closing valve 153 by magnetic force to supply water from the water container 150 to the water tank 130.

That is, a permanent magnet or a magnetic force member 158 made of a material with strong magnetism may be mounted at a front end of the rod member 156 of the opening/closing valve 153, and in response thereto, the base unit 115 of the housing 110 may include a solenoid magnet 178 to which magnetic force is applied by power supply.

Accordingly, when magnetic force is applied to the solenoid magnet 178 constituting the water supply control member 170 by the driving unit 180, the opening/closing valve 153 may be opened and closed.

For example, as shown in FIG. 10, when magnetic force is applied to the solenoid magnet 178 so that repulsive force acts between the magnetic force member 158 and the solenoid magnet 178, the magnetic force member 158 rises by the repulsive force, and accordingly, the sealing member 155 opens the outlet of the cap member 154 to supply water from the water container 150 to the water tank 130.

While exemplary embodiments have been shown and described above, it will be apparent to those skilled in the art that modifications and variations could be made without departing from the scope of the present invention, as defined by the appended claims.

REFERENCE NUMERALS

100 . . . humidifier
110 . . . housing
111 . . . air inlet
112 . . . air outlet
115 . . . base unit
120 . . . air purifying filter
130 . . . water tank
131 . . . water accommodation space
140 . . . humidification member

150 . . . water container
151 . . . water container body
153 . . . opening/closing valve
154 . . . cap member
155 . . . sealing member
156 . . . rod member
157 . . . elastic member
158 . . . magnetic member
160 . . . water container support member
161 . . . rotation support unit
162 . . . seating surface
163 . . . mounting opening
165 . . . through-hole
170 . . . water supply control member
171 . . . operating unit
172 . . . protrusion unit
173 . . . contact member
173*a* . . . rack gear unit
174 . . . first magnet member
176 . . . shaft
177 . . . lifting and lowering pressing unit
178 . . . solenoid magnet
180 . . . driving unit
181 . . . driving gear
185 . . . wheel member
186 . . . second magnet member
190 . . . blowing unit
191 . . . blowing fan
192 . . . fan motor
B . . . auxiliary power unit
C . . . control unit
D . . . guide unit
LS . . . water level sensor

The invention claimed is:

1. A humidifier, comprising:

a water tank installed inside a housing, and storing water;

a humidification member immersed in the water stored in the water tank and performing humidification;

a water container provided with an opening/closing valve which is opened and closed to supply water stored therein to the water tank;

a water container support member which is detachably mounted on an upper portion of the water tank and on which the water container is seated; and a water supply control member which is mounted on the water container support member, and opens and closes the opening/closing valve so that the water can be supplied from the water container to the water tank, wherein the water supply control member includes a lifting and lowering pressing arm to move to ascend and descend to press the opening/closing valve, wherein the water supply control member includes a shaft mounted on the water container support member, the lifting and lowering pressing arm formed to extend to a first side of the shaft, and an operating arm formed to extend to a second side of the shaft that is opposite to the first side, wherein the lifting and lowering pressing arm rotates about the shaft as an axis according to the movement of the operating arm and ascends and descends, wherein the humidifier further comprises a driving unit for rotating the operating with arm of the water supply control member about the shaft, wherein a first magnet member is installed in the operating arm, wherein the driving unit includes a second magnet member applying attractive force to the first magnet member, wherein the driving unit includes a wheel member rotating about a wheel shaft, and wherein the second magnet member is installed on the wheel member and is configured to approach or move to be away from the first magnet member as the wheel member rotates about the wheel shaft.

2. The humidifier of claim 1, wherein the water container support member has a rotation support unit on which the shaft is rotatably installed.

3. The humidifier of claim 1, wherein the driving unit is disposed in the housing.

4. The humidifier of claim 1, wherein the water supply control member includes a protrusion unit formed to protrude upwardly of the operating arm, and a contact member that slidably moves while in contact with the protrusion unit so that the lifting and lowering pressing arm ascends, wherein the driving unit is configured to slidably move the contact member.

5. The humidifier of claim 4, wherein the driving unit includes a driving gear rotated by a motor and engaged with a rack gear unit formed on the contact member.

6. The humidifier of claim 1, wherein the opening/closing valve includes a cap member coupled to an inlet of the water container, a seal that is configured to seal an outlet formed in the cap member, a rod member for ascending and descending the seal, and an elastic member providing elastic force so that the seal seals the outlet of the cap member.

7. The humidifier of claim 1, further comprising, a water level sensor for measuring a water level of the water stored in the water tank; and a controller configured to control movement of the water supply control member to open and close the opening/closing valve according to the water level detected by the water level sensor.

8. The humidifier of claim 1, further comprising an auxiliary power supply unit for supplying reserve power when a power supply is cut off; and a controller configured to control the movement of the water supply control member, wherein the controller returns the water supply control member to an initial position by using power of the auxiliary power unit so that the opening/closing valve is closed when the power supply is cut off.

9. The humidifier of claim 1, further comprising a blower configured to provide a blowing force so that air introduced from an air inlet flows to an air outlet through the humidification member.

10. The humidifier of claim 9, further comprising a guide configured to indicate to a user via visual or auditory guidance that an abnormal state has occurred; and a controller configured to control driving of the blower, wherein the controller guides through the guide so that the user can empty the water tank after a certain time has elapsed after driving of the blower is finished.

11. The humidifier of claim 1, further comprising an air purifying filter for purifying air introduced from an air inlet.

12. The humidifier of claim 1, wherein the humidification member includes a humidification filter.

* * * * *